US010876267B2

(12) United States Patent
Stroyer

(10) Patent No.: US 10,876,267 B2
(45) **Date of Patent: *Dec. 29, 2020**

(54) AUGER GROUTED DISPLACEMENT PILE

(71) Applicant: Benjamin G. Stroyer, East Rochester, NY (US)

(72) Inventor: Benjamin G. Stroyer, East Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/664,226

(22) Filed: Oct. 25, 2019

(65) Prior Publication Data

US 2020/0165789 A1 May 28, 2020

Related U.S. Application Data

(63) Continuation of application No. 14/577,363, filed on Dec. 19, 2014, now Pat. No. 10,480,144, which is a continuation of application No. 13/269,595, filed on Oct. 9, 2011, now Pat. No. 8,926,228, which is a continuation-in-part of application No. 12/580,004, filed on Oct. 15, 2009, now Pat. No. 8,033,757, which (Continued)

(51) Int. Cl.

| | |
|---|---|
| ***E02D 5/56*** | (2006.01) |
| ***E02D 5/34*** | (2006.01) |
| ***E02D 5/36*** | (2006.01) |
| ***E02D 5/52*** | (2006.01) |
| ***E02D 11/00*** | (2006.01) |
| ***E02D 27/12*** | (2006.01) |

(52) U.S. Cl.

CPC ..... *E02D 5/34* (2013.01); *E02D 5/36* (2013.01); *E02D 5/52* (2013.01); *E02D 5/56* (2013.01); *E02D 11/00* (2013.01); *E02D 27/12* (2013.01)

(58) Field of Classification Search

USPC ..... 405/231, 232, 233, 236, 241, 249, 250, 405/251, 252.1, 253, 254; 175/394, 323, 175/408

See application file for complete search history.

(56) References Cited

U.S. PATENT DOCUMENTS

| | | | |
|---|---|---|---|
| 109,337 | A | 11/1870 | Moseley |
| 935,081 | A | 9/1909 | Wolfsholz |
| 1,307,160 | A | 6/1919 | Stokes |

(Continued)

FOREIGN PATENT DOCUMENTS

| | | |
|---|---|---|
| JP | 05086791 | 4/1993 |
| KR | 100841735 | 6/2008 |

(Continued)

OTHER PUBLICATIONS

Kporean Intellectual Property Office Internatiaonl Search Report for PCT/US2010/050869, dated Feb. 24, 2011 Feb. 24, 2011.

*Primary Examiner* — Sean D Andrish

(57) ABSTRACT

A method and apparatus place an auger grouted displacement pile or helical pile in soil. The pile has an elongated shaft with at least one lateral compaction protrusion which establishes a regular circumference in the supporting medium. The pile also has a helical blade configured to move the pile into the supporting medium. The bottom of the shaft includes means for forming irregularities in the circumference after compaction by the lateral compaction protrusion. The bore is filled with grout while leaving the pile in the soil.

16 Claims, 19 Drawing Sheets

Related U.S. Application Data is a continuation-in-part of application No. 11/852,858, filed on Sep. 10, 2007, now abandoned.

(60) Provisional application No. 60/843,015, filed on Sep. 8, 2006.

(56) References Cited

U.S. PATENT DOCUMENTS

| | | | |
|---|---|---|---|
| 2,911,239 | A | 11/1959 | Marzolf, Sr. |
| 3,243,962 | A | 4/1966 | Ratliff |
| 3,690,109 | A | 9/1972 | Turzillo |
| 3,875,751 | A | 4/1975 | Paus |
| 3,969,902 | A | 7/1976 | Ichise et al. |
| 4,072,017 | A | 2/1978 | Shiraki |
| 4,360,599 | A | 11/1982 | Loken et al. |
| 4,504,173 | A | 3/1985 | Feklin |
| 4,533,279 | A | 8/1985 | van den Elzen et al. |
| 4,659,259 | A | 4/1987 | Reed et al. |
| 5,219,246 | A | 6/1993 | Coutts et al. |
| 5,378,085 | A | 1/1995 | Kono et al. |
| 5,575,593 | A | 11/1996 | Raaf |
| 5,707,180 | A | 1/1998 | Vickars et al. |
| 5,722,498 | A | 3/1998 | Van Impe et al. |
| 5,907,447 | A | 5/1999 | Sutton et al. |
| 5,919,005 | A | 7/1999 | Rupiper |
| 5,934,836 | A | 8/1999 | Rupiper et al. |
| 6,033,152 | A | 3/2000 | Blum |
| 6,264,402 | B1 | 7/2001 | Vickars et al. |
| 6,283,231 | B1 | 9/2001 | Coelus |
| 6,402,432 | B1 | 6/2002 | England et al. |
| 6,435,776 | B2 | 8/2002 | Vickars et al. |
| 6,503,024 | B2 | 1/2003 | Rupiper |
| 6,615,554 | B2 | 9/2003 | Rupiper |
| 6,652,195 | B2 | 11/2003 | Vickars et al. |
| 6,672,015 | B2 | 1/2004 | Cognon |
| 6,722,821 | B1 | 4/2004 | Perko et al. |
| 6,799,924 | B1 | 10/2004 | Kight et al. |
| 6,814,525 | B1 | 11/2004 | Whitsett |
| 6,902,352 | B2 | 6/2005 | Kim |
| 6,966,727 | B2 | 11/2005 | Kight et al. |
| 7,004,683 | B1 | 2/2006 | Rupiper |
| 7,198,434 | B2 | 4/2007 | Blum |
| 7,314,335 | B2 | 1/2008 | Whitsett |
| 7,338,232 | B2 | 3/2008 | Nasr |
| 8,033,757 | B2 | 10/2011 | Stroyer |
| 2001/0045067 | A1 | 11/2001 | Cognon |
| 2004/0105727 | A1* | 6/2004 | Jones ..... E02D 5/523 405/231 |
| 2005/0031418 | A1 | 2/2005 | Whitsett |
| 2006/0013656 | A1 | 1/2006 | Blum |
| 2006/0260849 | A1 | 11/2006 | Pedrelli |
| 2007/0286685 | A1 | 12/2007 | Lindsey |
| 2007/0286686 | A1 | 12/2007 | Lindsey |
| 2008/0063479 | A1 | 3/2008 | Stroyer |

FOREIGN PATENT DOCUMENTS

| | | |
|---|---|---|
| KR | 100894988 | 4/2009 |
| WO | WO2004020744 | 3/2009 |

* cited by examiner

AUGER GROUTED DISPLACEMENT PILE

PRIORITY INFORMATION

The present application is a continuation of U.S. patent application Ser. No. 14/577,363, filed on Dec. 19, 2014; said U.S. patent application Ser. No. 14/577,363, filed on Dec. 19, 2014, which is a continuation of and claims priority, under 35 U.S.C. § 120, from U.S. patent application Ser. No. 13/269,595, filed on Oct. 9, 2011; said U.S. patent application Ser. No. 13/269,595, filed on Oct. 9, 2011, which is a continuation-in-part of and claims priority, under 35 U.S.C. § 120, from U.S. patent application Ser. No. 12/580,004, filed on Oct. 15, 2009; said U.S. patent application Ser. No. 12/580,004, filed on Oct. 15, 2009, which is a continuation-in-part of and claims priority, under 35 U.S.C. § 120, from U.S. patent application Ser. No. 11/852,858, filed Sep. 10, 2007, (now abandoned); said U.S. patent application Ser. No. 11/852,858, filed Sep. 10, 2007, claims priority, under 35 U.S.C. § 119(e), from U.S. Provisional Patent Application No. 60/843,015, filed on Sep. 8, 2006. The entire contents of U.S. patent application Ser. No. 14/577,363, filed on Dec. 19, 2014; U.S. patent application Ser. No. 13/269,595, filed on Oct. 9, 2011; U.S. patent application Ser. No. 12/580,004, filed on Oct. 15, 2009; U.S. patent application Ser. No. 11/852,858, filed Sep. 10, 2007; and U.S. Provisional Patent Application No. 60/843,015, filed on Sep. 8, 2006 are hereby incorporated by reference.

BACKGROUND

Conventional piles are metal tubes having either a circular or a rectangular cross-section. Such piles are mounted in the ground to provide a support structure for the construction of superstructures. The piles are provided in sections, such as seven-foot sections, that are driven into the ground.

Some piles have a cutting tip that permits them to be rapidly deployed. By rotating the pile, the blade pulls the pile into the ground, thus greatly reducing the amount of downward force necessary to bury the pile.

For example, a pile may include a tip that is configured to move downward into the soil at a rate of three inches for every full revolution of the pile (three inch pitch). Since pre-drilling operations are unnecessary, the entire pile may be installed in under ten minutes. Unfortunately, the rotary action of the pile also loosens the soil which holds the pile in place. This reduces the amount of vertical support the pile provides.

Traditionally, grout is injected around the pile in an attempt to solidify the volume around the pile and thus compensate for the loose soil. The current method of grout deployment is less than ideal. The addition of grout to the area around the pile typically is uncontrolled and attempts to deploy grout uniformly about the pile have been unsuccessful. Often the introduction of the grout itself can cause other soil packing problems, as the soil must necessarily be compressed by the introduction of the grout.

A new method for introducing grout around a pile would be advantageous.

BRIEF DESCRIPTION OF THE DRAWINGS

The drawings are only for purposes of illustrating various embodiments and are not to be construed as limiting, wherein.

DETAILED DESCRIPTION

Figure 1:
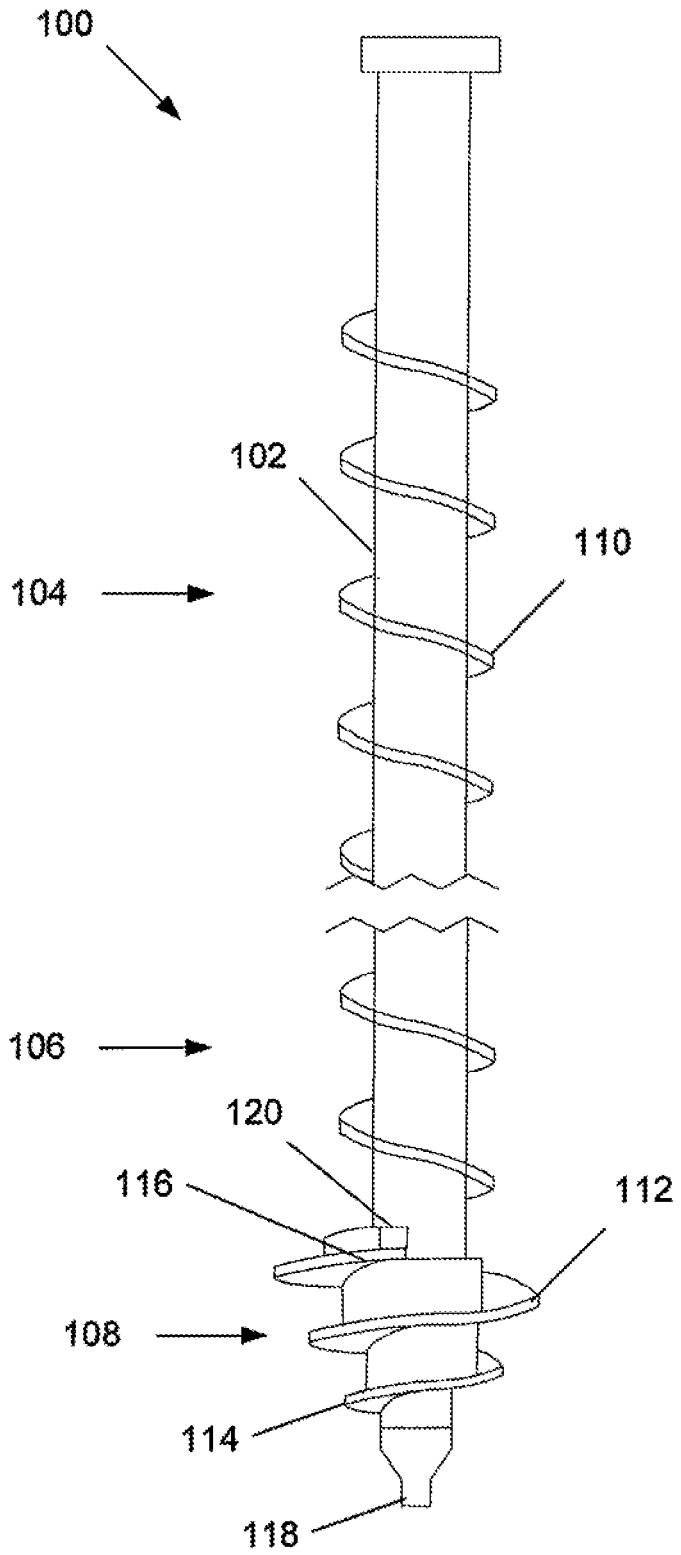
FIG. 1 illustrates a schematic view of one embodiment of an auger grouted displacement pile.

For a general understanding, reference is made to the drawings. In the drawings, like references have been used throughout to designate identical or equivalent elements. It is also noted that the drawings may not have been drawn to scale and that certain regions may have been purposely drawn disproportionately so that the features and concepts may be properly illustrated.

Referring to FIG. 1, auger grouted displacement pile 100 includes an elongated, tubular pipe 102 with a hollow central chamber 300 (see FIG. 3A), a top section 104 and a bottom section 106. Bottom section 106 includes a soil displacement head 108. Top section 104 includes an auger 110. Soil displacement head 108 has a blade 112 that has a leading edge 114 and a trailing edge 116. The leading edge 114 of blade 112 cuts into the soil as the pile is rotated and loosens the soil at such contact point. The soil displacement head 108 may be equipped with a point 118 to promote this cutting. The loosened soil passes over blade 112 and thereafter past trailing edge 116. Trailing edge 116 is configured to supply grout at the position where the soil was loosened. The uppermost rotation of blade 112 includes a deformation structure 120 that displaces the soil as the blade 112 cuts into the soil.

Figure 2A:
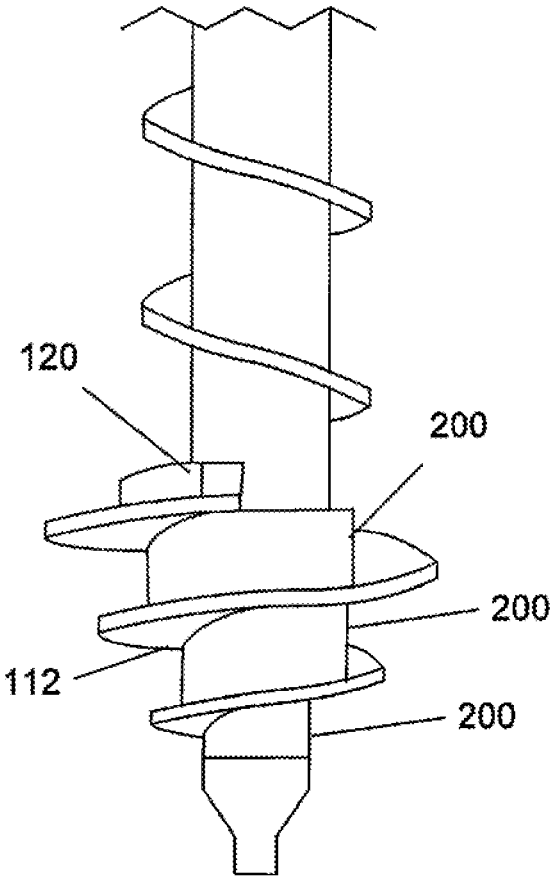
FIGS. 2A and 2B illustrate close-up views of the bottom section of a pile.
Figure 2B:
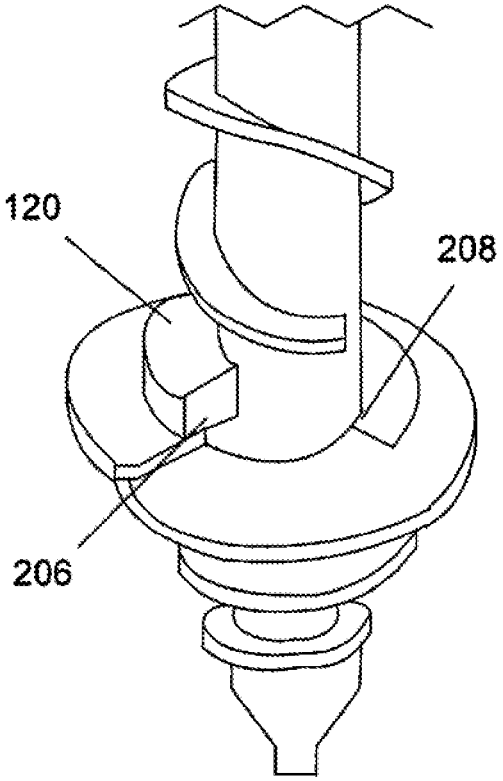

FIGS. 2A and 2B are side and perspective views of the bottom section 106. Bottom section 106 includes at least one lateral compaction element 200. In the embodiment shows in FIGS. 2A and 2B, there are three such elements. The element near point 118 has a diameter less than the diameter from the element near deformation structure 120. The element in the middle has a diameter that is between the diameters of the other two elements. In this fashion, the soil is laterally compacted by the first element, more compacted by the second element (enlarging the diameter of the bored hole) and even more compacted by the third element. The blade 112 primarily cuts into the soil and only performs minimal soil compaction. The deformation structure 120 is disposed above the lateral compaction elements 200. After the widest compaction element 200 has established a hole with a regular diameter, deformation structure 120 cuts into the edge of the hole to leave a spiral pattern in the hole's perimeter or circumference.

In the embodiment shown in FIGS. 2A and 2B, deformation structure 120 is disposed on the top surface of blade 112. The deformation structure 120 shown in FIGS. 2A and 2B is shown in profile in FIG. 2C. The structure 120 has a width 202 and a height 204. As can be appreciated from FIG. 2B, the height 204 changes over the length of the deformation structure 120 from its greatest height at end 206 to a lesser height at end 208 as the structure coils about tubular pipe 102 in a helical configuration. In FIG. 2B, end 206 is flush with the surface of the blade.

Figure 2C:
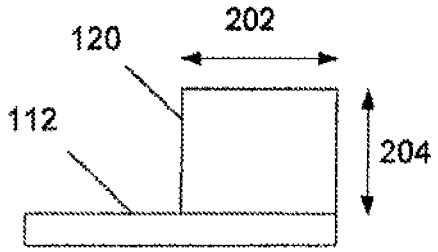
FIGS. 2C-2J illustrate end views of various deformation structures.
Figure 2D:
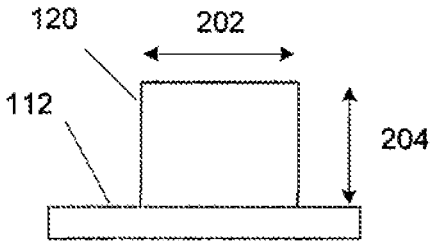
Figure 2E:
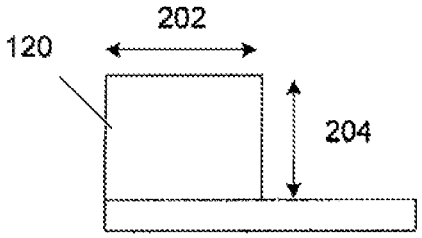
Figure 2F:
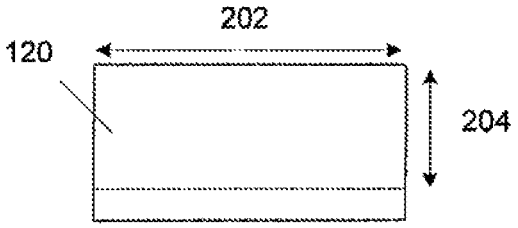
Figure 2G:
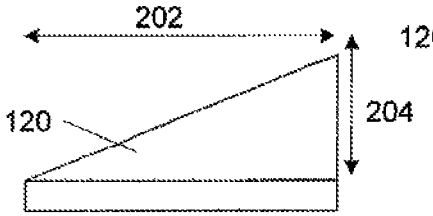
Figure 2H:
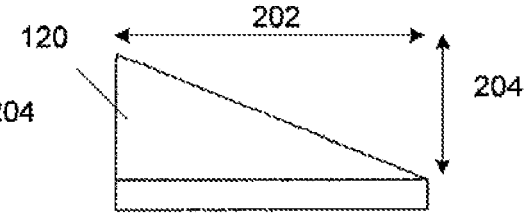
Figure 2I:
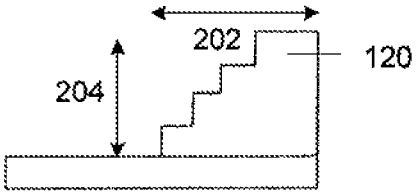
Figure 2J:
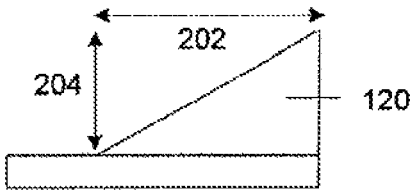

The deformation structure shown in FIGS. 2A through 2C is only one possible deformation structure. Examples of other deformation structures are illustrated in FIGS. 2D through 2J, each of which is shown from the perspective of end 206. For example, the structure may be disposed in the middle (FIG. 2D or outside edge (FIG. 2E) of the blade. The structure can traverse a section of the trailing edge (FIGS. 2C through 2E) or it may traverse the entire trailing edge (FIG. 2F). The structures need not be square or rectangular at the end 206.

Angled structures (FIGS. 2G and 2H) and stepwise structures (FIGS. 2I and 2J) are also contemplated. Other suitable configurations would be apparent to those skilled in the art after benefiting from reading this specification.

Advantageously, the deformation structure provides a surface for grout to grip the soil. Grout may be administered as shown in FIGS. 3A and 3B.

Figure 3A:
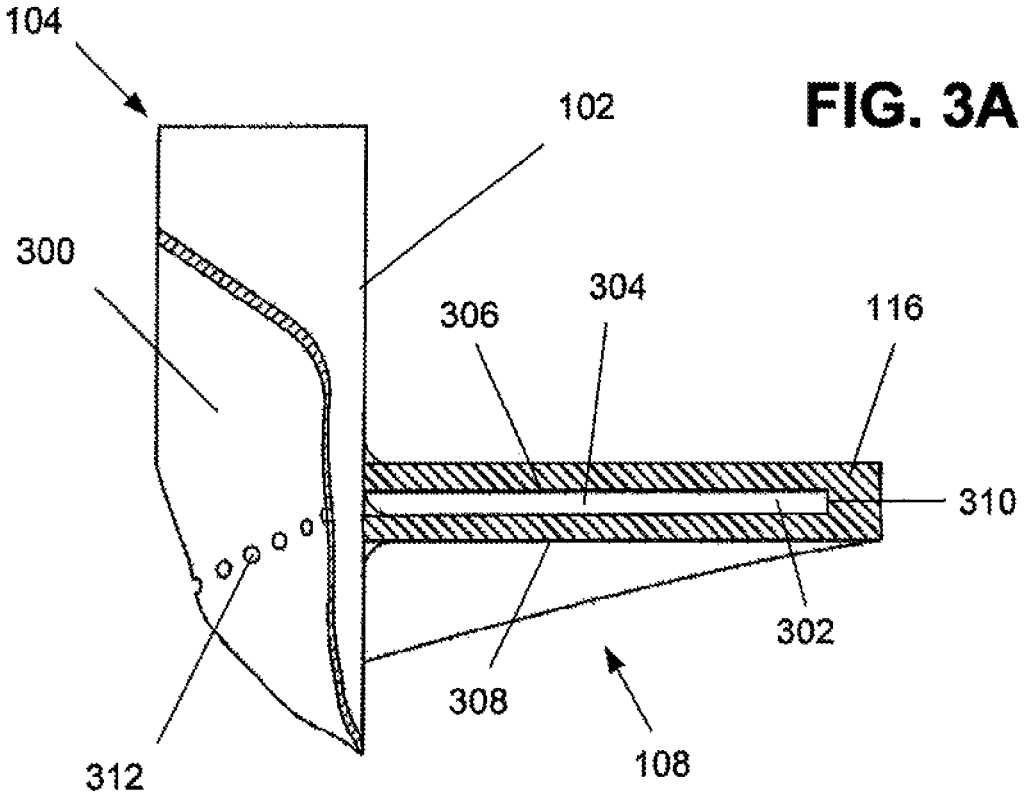
FIGS. 3A and 3B illustrate views of a trailing edge of a pile.

FIG. 3A illustrates the trailing edge 116 of soil displacement head 108 of FIG. 1. As shown in FIG. 3A, soil displacement head 108 has a trailing edge 116 that includes a means 302 for extruding grout. In the embodiment depicted in FIG. 3A, means 302 is an elongated opening 304. Elongated opening 304 is defined by parallel walls 306, 308 and a distal wall 310. The elongated opening 304 is in communication with the central chamber 300 via channels 312 in the pipe 102. Such channels 312 are in fluid communication with elongated opening 304 such that grout that is supplied to the central chamber 300 passes through channels 312 and out opening 304.

In the embodiment shown in FIG. 3A, channels 312 are circular holes. As would be appreciated by those skilled in the art after benefiting from reading this specification, such channels may have other configurations. For example, channels 312 may be elongated channels, rather than individual holes. The surface of blade 112 (not shown in FIG. 3A, but see FIG. 1) is solid such that there is no opening in the blade surface with openings only being present on the trailing edge. Advantageously, this avoids loosening soil by the action of grout extruding from the surfaces and sides of the blade. FIG. 3B shows the configuration of opening 304 relative to the configuration of trailing edge 116.

Figure 3B:
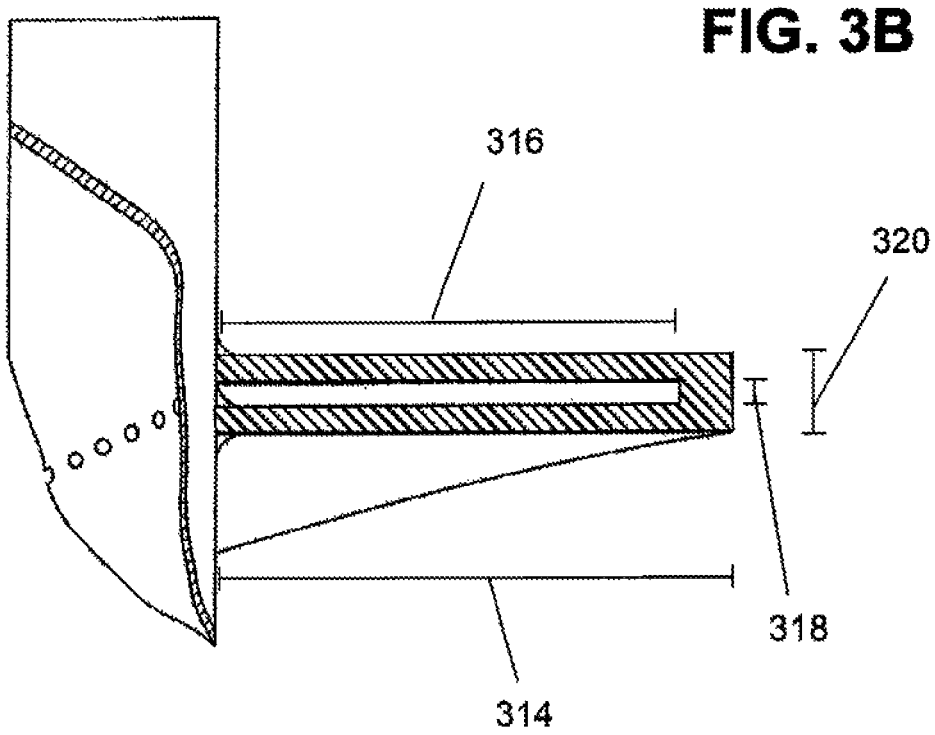

As shown in FIG. 3B, the thickness of blade 112 is substantially equal over its entire length. In the embodiment shown in FIG. 3B, opening 304 is an elongated opening that, like the blade 112, has a thickness that is substantially equal over the width of such opening. In one embodiment, opening 304 has a width 316 that is at least half the width 314 of the trailing edge. In another embodiment, opening 304 has a width 316 that is at least 80% the width of the trailing edge. The thickness 318 of the opening 304 likewise may be, for example, at least 25% of the thickness 320 of the trailing edge 116.

Figure 4:
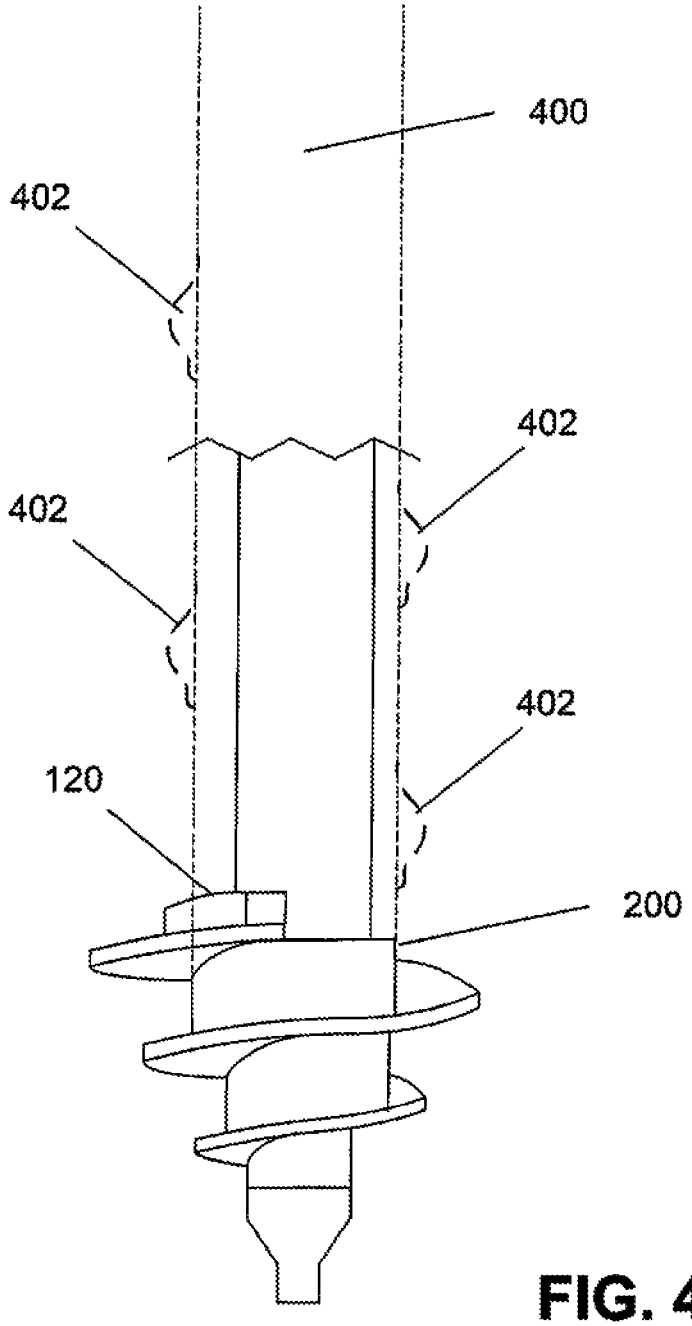
FIG. 4 illustrates a depiction of the soil displacement caused by a pile.

FIG. 4 depicts the deformation of the soil caused by deformation structure 120. During operation, the lateral compaction elements 200 creates a hole 400 with the diameter of the hole being established by the widest such element.

Since the walls of the lateral compaction elements are smooth, the hole established likewise has a smooth wall. Deformation structure 120 is disposed above the lateral compaction element and cuts into the smooth wall and leaves a spiral pattern cut into the soil. The side view of this spiral pattern is shown as grooves 402, but it should be understood that the pattern continues around the circumference of the hole. Grout that is extruded from trailing edge 116 seeps into this spiral pattern. Such a configuration increases the amount of bonding between the pile and the surrounding soil. The auger 110 of the top section 102 (see FIG. 1) does not extrude grout. Rather, the auger 110 provides lateral surfaces that grip the grout after it has set. The diameter of the auger 110 is generally less than the diameter of the blades 112 since the auger is not primarily responsible for cutting the soil, but rather, insuring that the grout column is complete and continuous by constantly augering the grout downward into the voids created by the deformation structure and the lateral displacement element. The flanges that form the auger 110 have, in one embodiment, a width of about two inches.

The blade 112 has a helical configuration with a handedness that moves soil away from point 118 and toward the top section where it contacts lateral compaction element 200. Auger 110, however, has a helical configuration with a handedness opposite that of the blades 112. The handedness of the auger helix pushes the grout that is extruded from the trailing edge 116 toward the bottom section. In one embodiment, the auger 110 has a pitch of from about 1.5 to 2.0 times the pitch of the blade 112. The blade may have any suitable pitch known in the art. For example, the blade may have a pitch of about three inches. In another embodiment, the blade may have a pitch of about six inches.

Figure 5A:
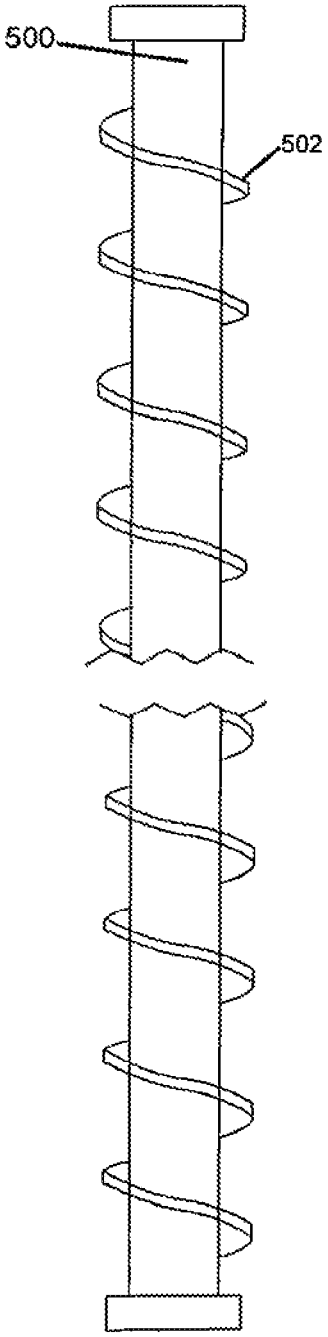
FIGS. 5A and 5B illustrate two supplemental piles that may optionally be attached to the auger grouted displacement pile.
Figure 5B:
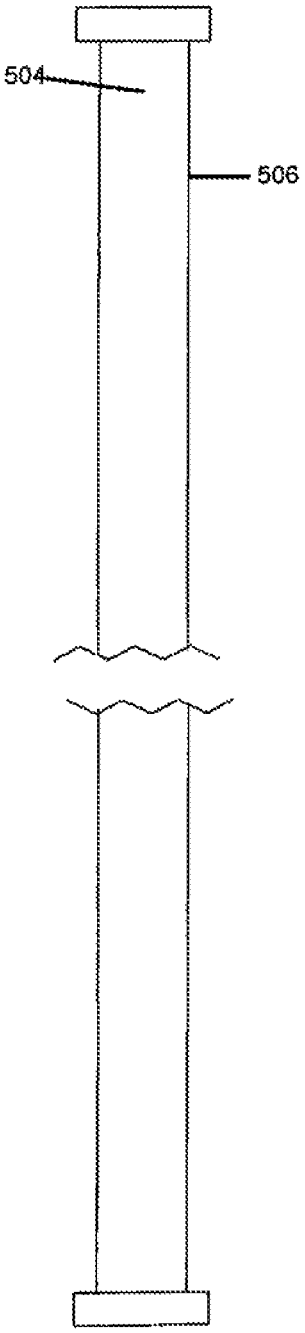

FIGS. 5A and 5B are depictions of two piles that may be used in conjunction with the auger grouted displacement pile of FIG. 1. FIG. 5A depicts a pile 500 with an auger section 502 similar to those described with regard to FIG. 1. Such a pile may be connected to the pile of FIG. 1. FIG. 5B is a pile 504 that lacks the auger: its surface 506 is smooth.

In some embodiments, one or more auger-including piles are topped by a smooth pile such as the pile depicted in FIG. 5B. This smooth pile avoids drag-down in compressive soils and may be desirable as the upper most pile.

Figure 6:
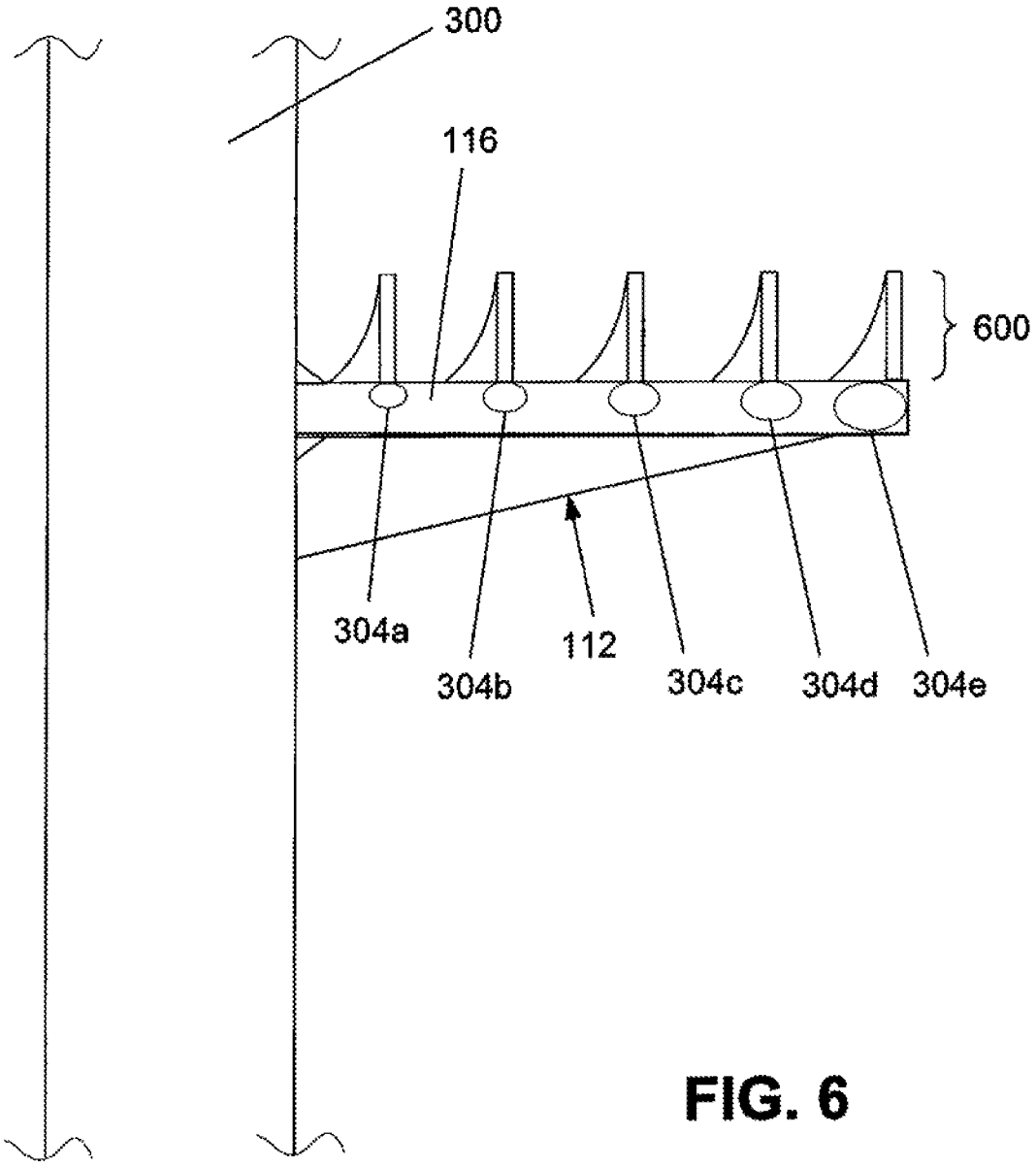
FIG. 6 illustrates a depiction of one grout delivery system.

FIG. 6 is a close-up view of a soil displacement head 108 that includes a plurality of mixing fins 600. Mixing fins 600 are raised fins that extend parallel to one another over the surface of blade 112. The fins mix the grout that is extruded out of openings 304*a*-304*e* with the surrounding soil as the extrusion occurs. The mixing of the grout with the surrounding soil produces a grout/soil layer that is thicker than the trailing edge and, in some embodiments, produces a single column of solidified grout/soil.

Referring again to FIG. 6, trailing edge 116 has several openings 304*a*-304*e* which are in fluid communication with central chamber 300. To ensure grout is delivered evenly from all of the openings, the opening diameters are adjusted so that grout is easily extruded from the large openings (such as opening 304*e*) while restricting the flow of grout from the small openings (such as opening 304*a*). Since opening 304*a* is near the central chamber 300, the grout is extruded with relatively high force. This extrusion would lower the rate at which grout is extruded through the openings that are downstream from opening 304*a*. To compensate, the diameters of each of the openings 304*a*-304*e* increases as the opening is more distance from the central chamber 300.

In this manner, the volume of grout extruded over the length of trailing edge 116 is substantially even. In one embodiment, the grout is forced through the pile with a pressurized grout source unit. In another embodiment, the grout is allowed to flow through the system using the weight of the grout itself to cause the grout to flow. In one embodiment, the rate of extrusion of the grout is proportional to the rate of rotation of the pile.

Figure 7A:
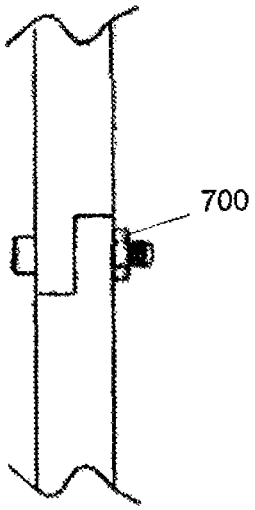
FIG. 7A Prior Art
FIGS. 7A-7C illustrate side views of conventional pile couplings.
Figure 7B:
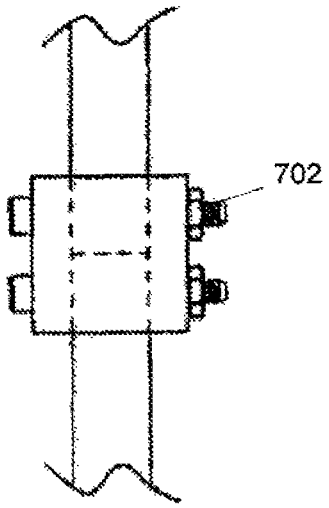
FIG. 7B Prior Art
Figure 7C:
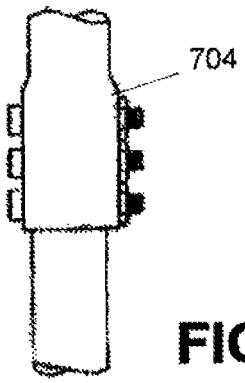
FIG. 7C Prior Art

Referring to FIGS. 8, 9, 10A, and 10B, there is shown a pile assembly with a specific pile coupling. Conventional pile couplings 700, 702 or 704 may also be used (see FIGS. 7A to 7C). The assembly 800 includes two pile sections 802*a* and 802*b*, each of which is affixed to or integral with a respective flange 804*a* and 804*b*. Although only portions of pile sections 802*a* and 802*b* and one coupling are shown, the assembly 800 may include any number of pile sections connected in series with the coupling of the present invention.

The flanges 804*a* and 804*b* each include a number of clearance holes 1000 spaced apart on the flanges such that the holes 1000 line up when the flange 804*a* is abutted against flange 804*b*. The abutting flanges 804*a* and 804*b* are secured by fasteners 806, such as the bolts shown in FIG. 8, or any other suitable fastener. The fasteners 806 pass through the holes 1000 such that they are oriented in a direction substantially parallel to the axis of the pile. In one embodiment, shown in FIG. 10A, the flange 804*a* includes six spaced holes 1000. In another embodiment, shown in FIG. 10B, the flange 804*a* includes eight spaced holes 1000. The eight-hole embodiment allows more fasteners 806 to be used for applications requiring a stronger coupling while the six-hole embodiment is economically advantageous allowing for fewer, yet evenly-spaced, fasteners 806.

In another embodiment, the flanges 804*a*, 804*b* are in each in a plane that is substantially transverse to the longitudinal axis of the pile sections 802*a*, 802*b*. Particularly, at least one surface, such as the interface surface 900 (FIG. 9) extends in the substantially transverse plane. Further, the flanges 804*a*, 804*b* are slender and project a short distance from the pile sections 802*a*, 802*b* in the preferred embodiment. This minimizes the interaction of the flanges with the soil.

The vertical orientation of the fasteners allows the pile sections to be assembled without vertical slop or lateral deflection. Thus the assembled pile sections support the weight of a structure as well as upward and horizontal forces, such as those caused by the structure moving in the wind or due to an earthquake. Further, because the fasteners are vertically oriented, an upward force is applied along the axis of the fastener. Fasteners tend to be stronger along the axis than under shear stress.

In a particular embodiment, the pile sections 802*a* and 802*b* are about 3 inches in diameter or greater such that the piles support themselves without the need for grout reinforcement, though grout or another material may be used for added support as desired.

Since the flanges 804*a*, 804*b* may cause a gap to form between the walls of the pile sections 802*a*, 802*b* and the soil as the pile sections are driven into the soil, one may want to increase the skin friction between the pile sections and the soil for additional support capacity for the pile assembly 800 by adding a filler material 808 to fill the voids between the piles and the soil. The material 808 may also prevent corrosion. The material 808 may be any grout, a polymer coating, a flowable fill, or the like. Alternatively, the assembly 800 may be used with smaller piles, such as 1.5 inch diameter pile sections, which may be reinforced with grout. The pile sections 802*a*, 802*b* may be any substantially rigid material, such as steel or aluminum. One or more of the pile sections in the assembly 800 may be helical piles.

Figure 11:
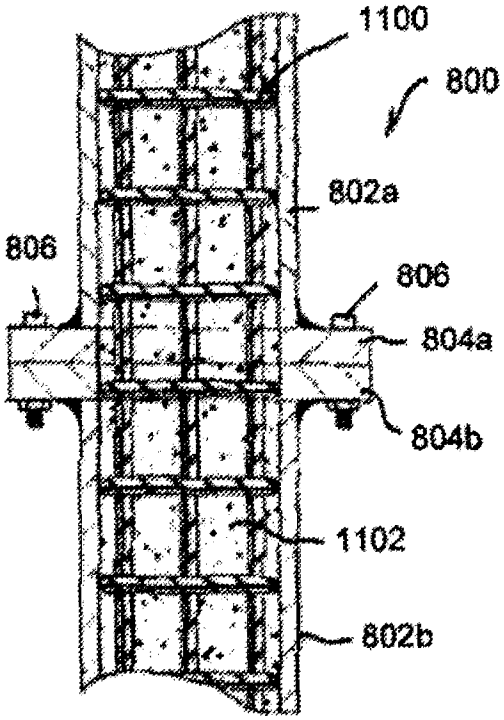
FIG. 11 illustrates a cross-sectional side view of a pile coupling with internal grout and an inserted rebar cage.

In a particular embodiment, the pile sections 802*a*, 802*b* are tubes having a circular cross-section, though any cross-sectional shape may be used, such as rectangles and other polygons. A particular advantage of the present invention over conventional pile couplings is that the couplings in the assembly 800 do not pass fasteners 806 through the interior of the pile tube. This leaves the interior of the assembled pile sections open so that grout or concrete may be easily introduced to the pile tube along the length of all the assembled pile sections. Further, a reinforcing structure, such as a rebar cage that may be dropped into the pile tube, may be used with the internal concrete. FIG. 11 shows such a cage 1100 with internal grout 1102 providing a particularly robust pile assembly 800.

Figure 12:
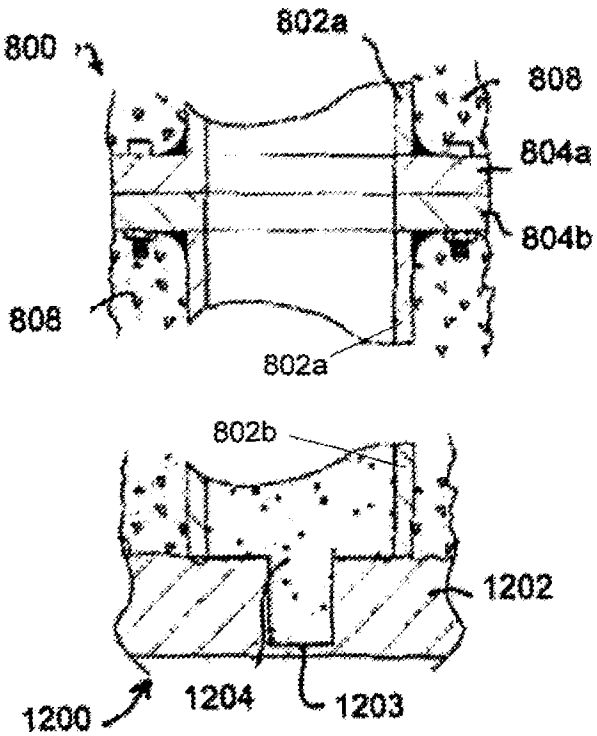
FIG. 12 illustrate a cross-sectional side view of a pile coupling with a rock socket.

In a further particular embodiment, the invention is used in conjunction with a rock socket. As shown in FIG. 12, the rock socket 1200 is formed by driving the pile sections into the ground and assembling them according to the invention until the first pile section hits the bedrock 1202. A drill is passed through the pile tube to drill into the bedrock 1202, forming hole 1203, and then concrete 1204 is introduced into the pile tube to fill the hole in the bedrock and at least a portion of the pile tube. This provides a strong connection between the assembled pile sections and the bedrock 1202.

Figure 8:
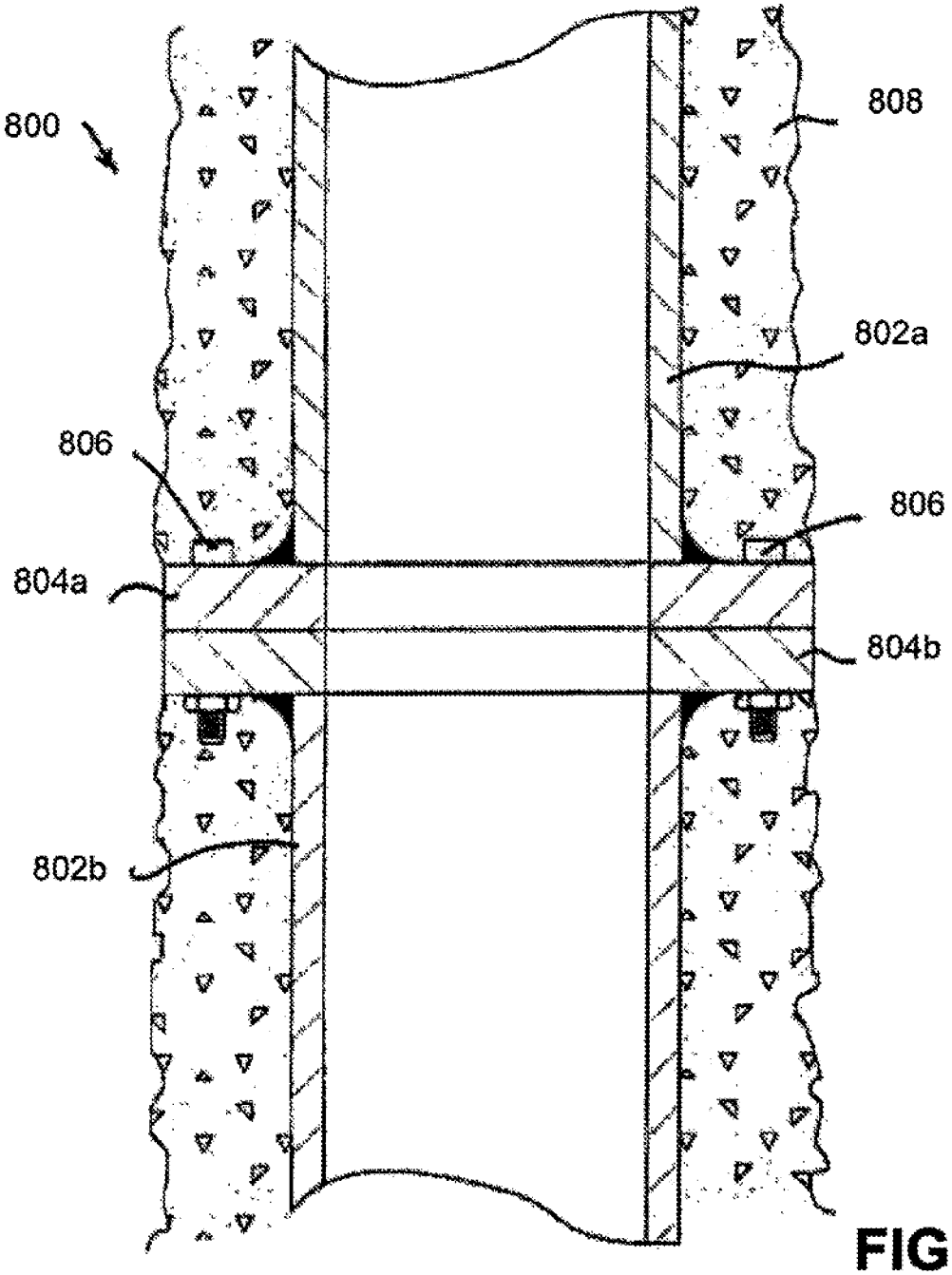
FIG. 8 illustrates a cross-sectional side view of a pile assembly having a pile coupling.
Figure 9:
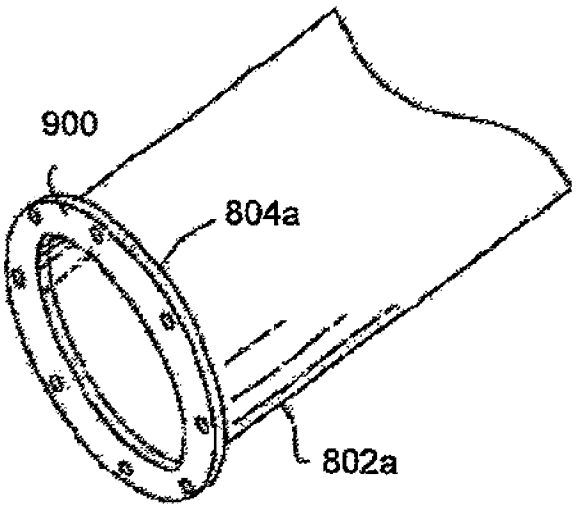
FIG. 9 illustrates an isometric view of the end of a pile section and flange of FIG. 8.
Figure 10A:
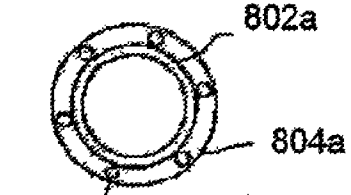
FIGS. 10A and 10B illustrate end views of pile sections and flanges.
Figure 10B:
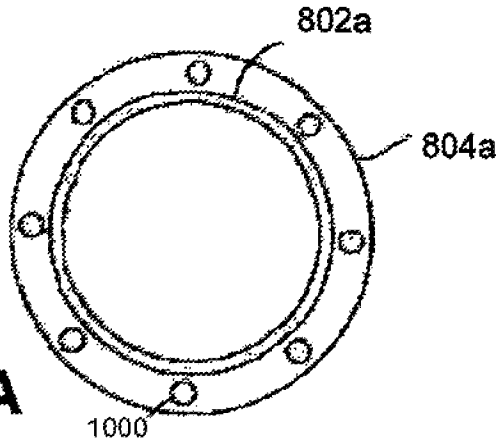
Figure 13:
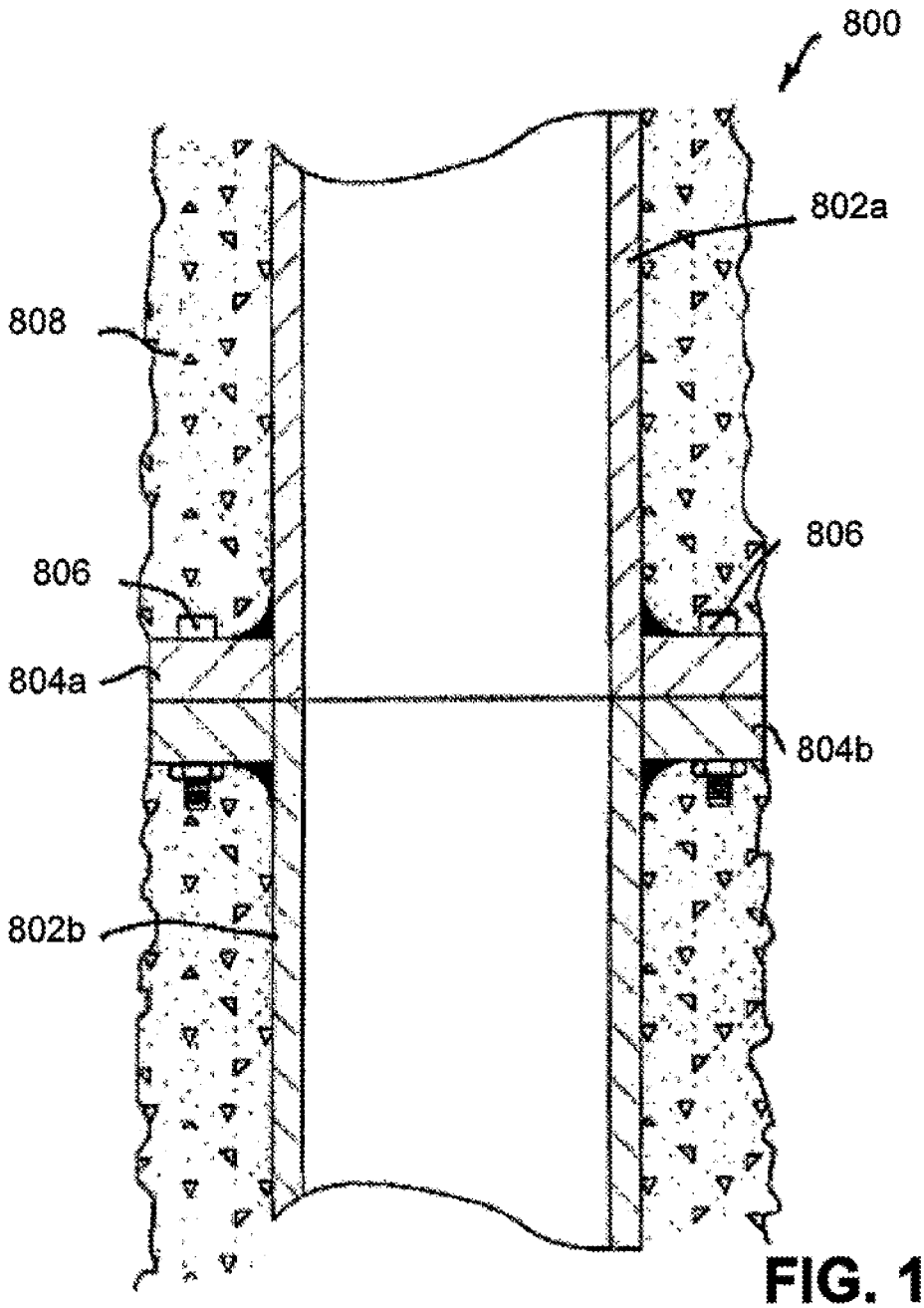
FIGS. 13-15 illustrate cross-sectional side views of pile assemblies having alternative pile couplings.

In an alternative configuration of the pile assembly 800, the flanges 804*a*, 804*b* are welded to or formed in the outer surface of the respective pile sections 802*a*, 802*b* as shown in FIG. 13 as opposed to the ends of the pile sections as shown in FIG. 8.

This allows the pile sections 802*a*, 802*b* to abut one another and thus provide a direct transfer of the load between the pile sections. In a further alternative configuration a gasket or o-ring is used to make the pile watertight. This has a particular advantage when passing through ground water or saturated soils. This feature keeps the interior of the pile clean and dry for the installation of concrete or other medium. It also provides a pressure tight conduit for pressurized grout injection through the pile and into the displacement head or any portion of the pile shaft that it is deemed most advantageous to the pile design.

Figure 14:
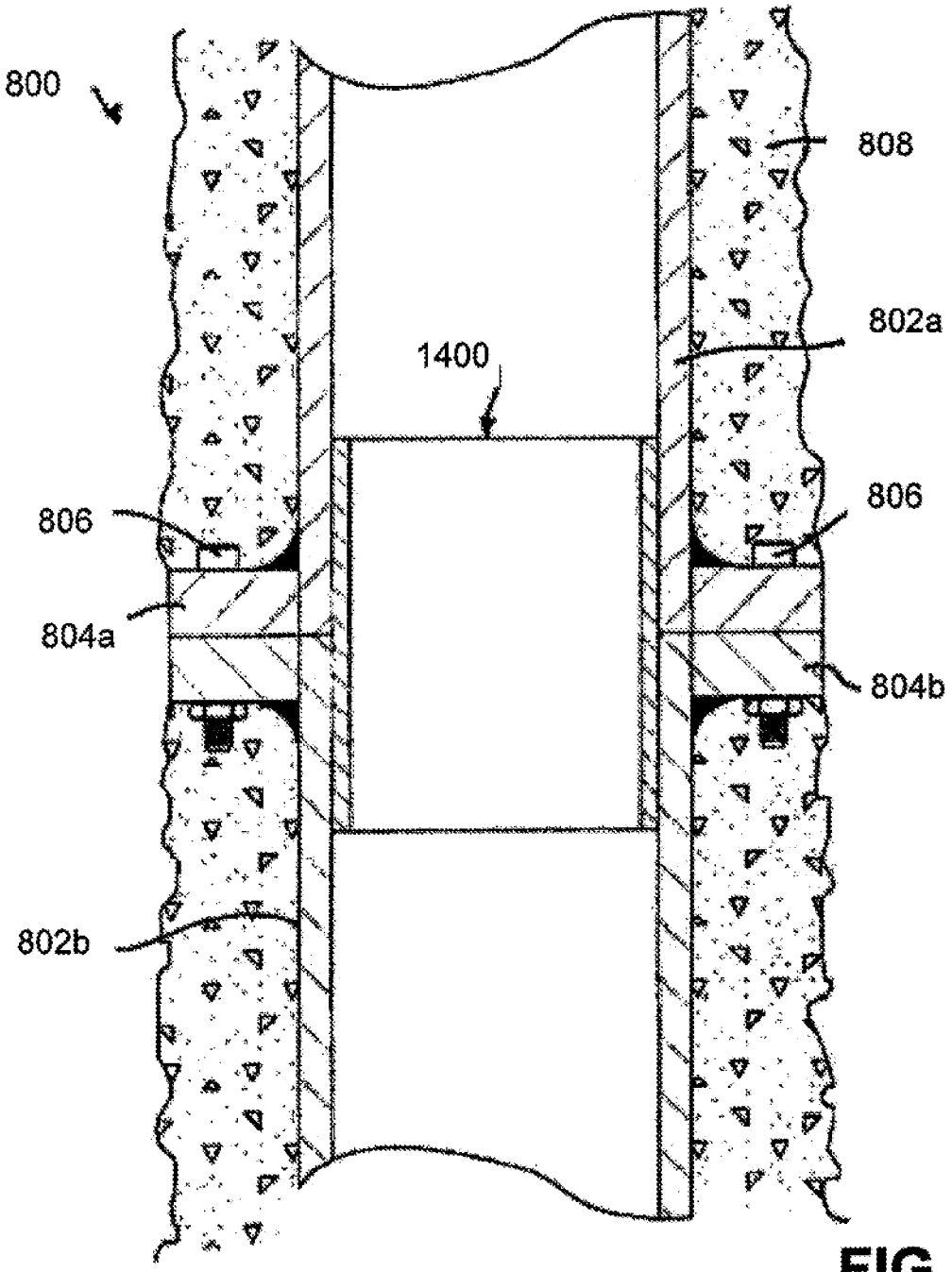

In a further alternative configuration, an alignment sleeve 1400 is included at the interface of the pile sections 802*a*, 802*b* as shown in FIG. 14. The alignment sleeve 1400 is installed with an interference fit, adhesive, welds, equivalents thereof, or combinations thereof. The alignment sleeve 1400 may be used with any of the embodiments described herein.

Figure 15:
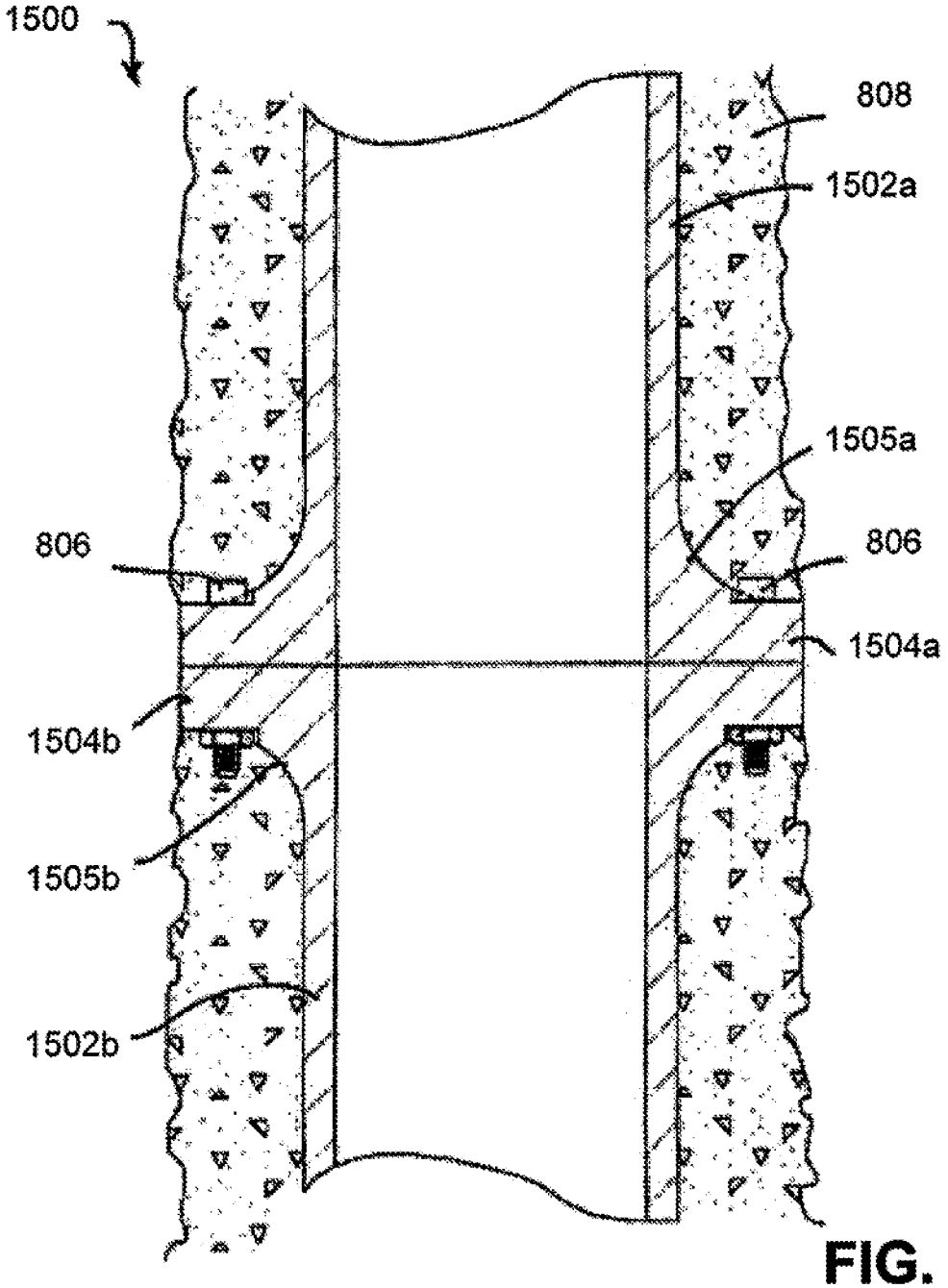

A pile assembly 1500 having an alternative coupling is shown in FIG. 15. The assembly 1500 includes pile sections 1502*a* and 1502*b* having integral filleted flanges 1504*a* and 1504*b*. The fillets 1505*a*, 1505*b* provide a stronger coupling and potentially ease the motion of the pile sections through soil. Similarly to the previous embodiments, the flanges

1504*a*, 1504*b* include several clearance holes for fasteners 806, and the assembly 1500 may be coated with or reinforced by a grout or other material 808.

Figures 16, 17:
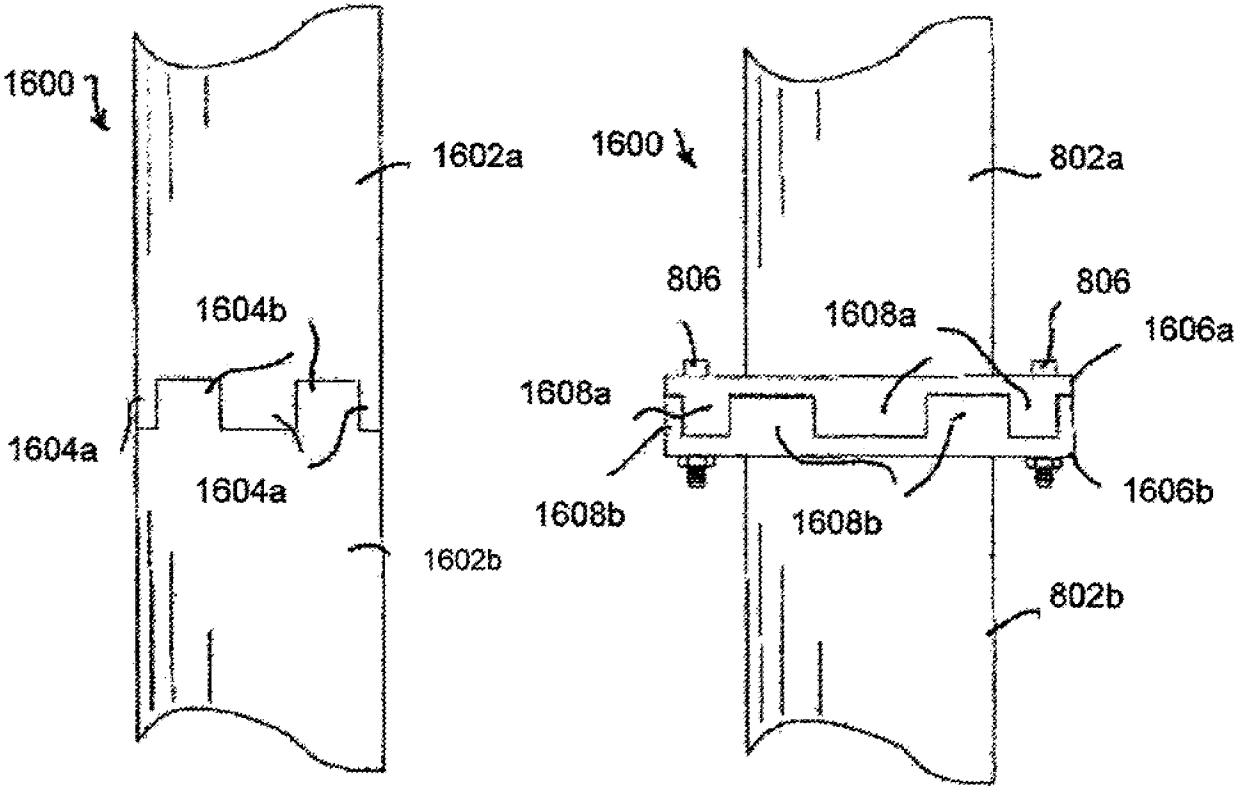
FIGS. 16 and 17 illustrate side views of pile assemblies having alternative pile couplings.

In a further alternative embodiment shown in FIGS. 15, 16 and 17, the pile assembly 1600 includes a coupling between the pile sections 1602*a*, 1602*b* with torsion resistance. In FIG. 15, the flanges are omitted for simplicity. The pile sections 1602*a*, 1602*b* include respective teeth 1604*a* and 1604*b* that interlock to provide adjacent surfaces between the pile sections 1602*a*, 1602*b* that are not perpendicular to the longitudinal axis of the pile sections. (While teeth having vertical walls are shown, teeth with slanted or curved walls may be used.) The teeth 1604*a*, 1604*b* may be integrally formed with the respective pile sections 1602*a*, 1602*b*. Alternatively, the teeth may be affixed to the respective pile sections.

In FIG. 16, the flanges 1606*a*, 1606*b* are shown with respective interlocking teeth 1608*a*, 1608*b*. The teeth 1608*a*, 1608*b* may be integrally formed with the respective flanges 1606*a*, 1606*b*. Alternatively, the teeth may be affixed to the respective flanges. The flanges 1606*a*, 1606*b* (see FIG. 17) may be used with pile sections 802*a*, 802*b* according to the first embodiment, pile sections 1602*a*, 1602*b* having teeth 1604*a*, 1604*b*, or other pile sections.

In the previous embodiments, any twisting forces on the pile sections, which would be expected especially when one or more of the pile sections is a helical pile, are transferred from one pile to the next through the fasteners 806. This places undesirable shear stresses on the fasteners 806. The interlocking teeth of the present embodiment provide adjacent surfaces between the pile sections that transfer torsion between the pile sections to thereby reduce the shear stresses on the fasteners 806.

It should be noted that the manifold connections in the above-described embodiments each provide a continuous plane along the length of the assembled pile sections allowing for neither lateral deflection nor vertical compression or tension loads. It should be further noted that features of the above-described embodiments may be combined in part or in total to form additional configurations and embodiments within the scope of the invention.

Figure 18:
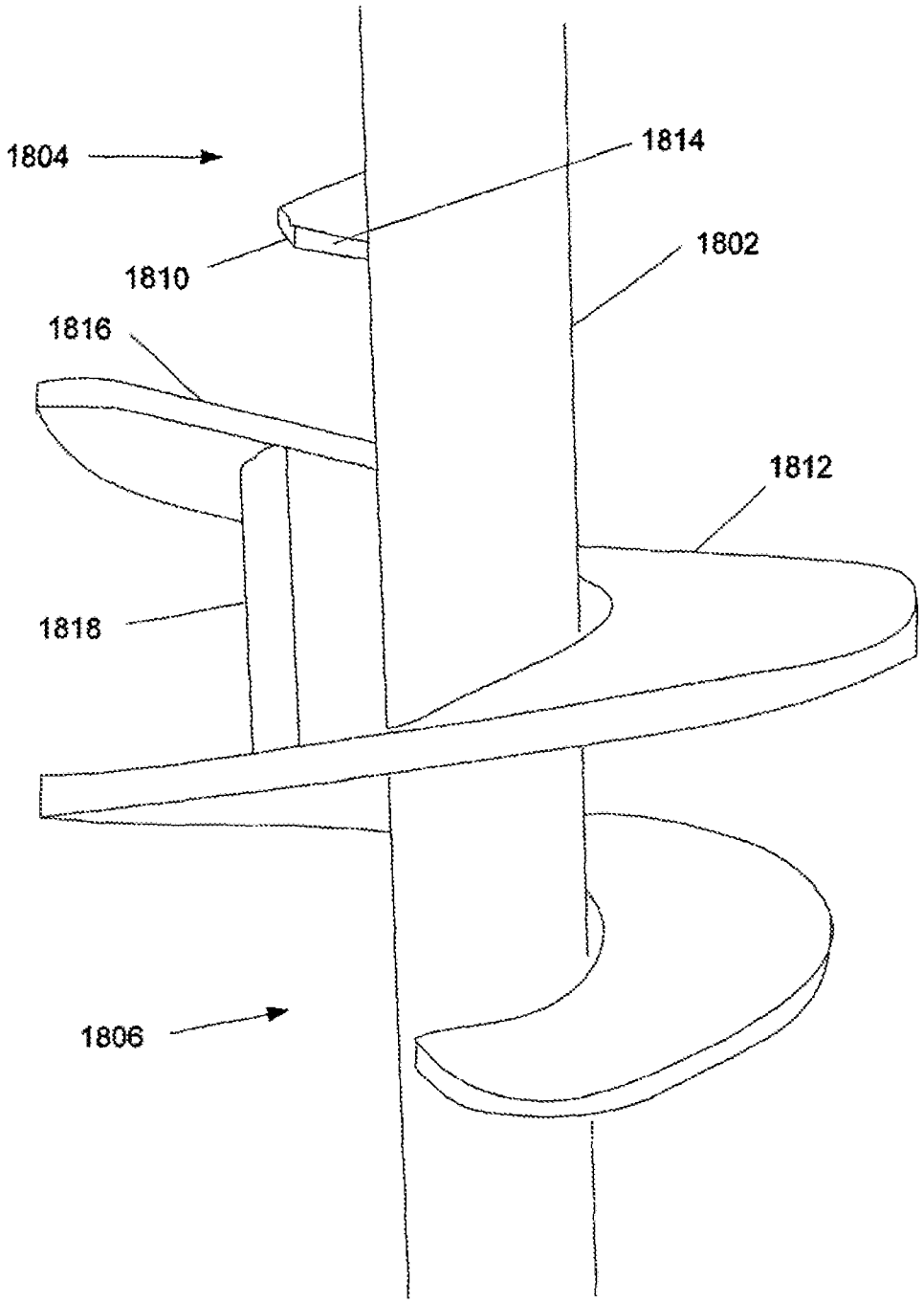
FIG. 18 illustrates the bottom section of an auger shaft.

Referring now to FIG. 18, the bottom section 1806 of another auger grouted displacement pile is shown. The end of top section 1804 is shown which includes auger 1810, which is similar to auger 110. Both auger 1810 and helical blade 1812 coil about shaft 1802. Shaft 1802 may be hollow or solid. In those embodiments where auger 1810 is present, the diameter of auger 1810 is smaller than the diameter of blades 1812. During installation, auger 1810 acts to push grout downward toward blades 1812. After the grout has set, the lateral surfaces of auger 1810 help transfer the load from the pile shaft into the grout column and the surrounding soils. Attached to the side of shaft 1802 is lateral compaction projection 1818.

In the embodiment illustrated in FIG. 18, projection 1818 is a gusset that spans between adjacent coils of blade 1812 and also contacts trailing edge 1816 of blade 1812. In one such embodiment, the gusset is welded to both of the adjacent coils of blade 1812.

In another embodiment, the lateral compaction projection is monolithic with respect to the shaft. In use, lateral compaction projection 1818 establishes a regular circumference which is subsequently filled with grout. For example, grout may be added around the shaft from its top during the installation of the shaft into the supporting medium. In one embodiment, lateral compaction projection 1818 is monolithic with regard to the shaft 1802. In another embodiment, lateral compaction projection 1818 is welded to shaft 1802.

Figure 19:
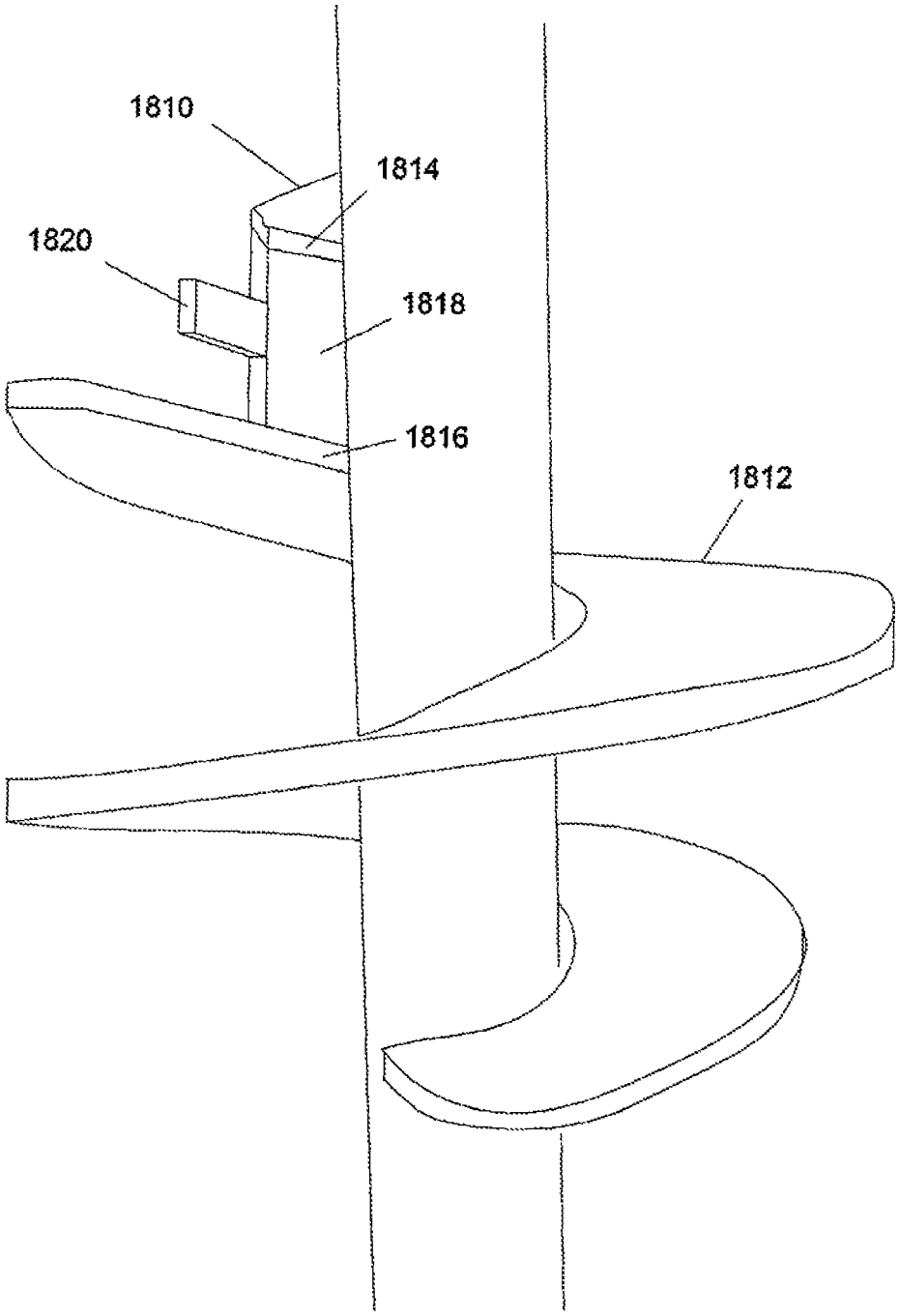
FIG. 19 illustrates the bottom section of another auger shaft.

FIG. 19 depicts another auger grouted displacement pile. The pile of FIG. 19 also includes a lateral compaction projection 1818 but the projection is disposed above the topmost flighting of the helical blade 1812 and below the bottommost flighting of the helical auger 1810. In the depicted embodiment, lateral compaction projection 1818 directly contacts the leading edge 1814 of auger 1810 and the trailing edge 1816 of blade 1812. In one such embodiment, the compaction projection 1818 is welded to one or both of auger 1810 and helical blade 1812 at the point of direct contact.

In another embodiment, the projection 1818 is between the bottommost and topmost flightings but is separated therefrom. The embodiment of FIG. 19 also differs from that of FIG. 18 in that it includes deformation structure 1820. Like deformation structure 120, deformation structure 1820 forms irregularities in the circumference after compaction by the lateral compaction protrusion 1818. In FIG. 19, deformation structure 1820 extends laterally from lateral compaction protrusion 1818.

Figure 20A:
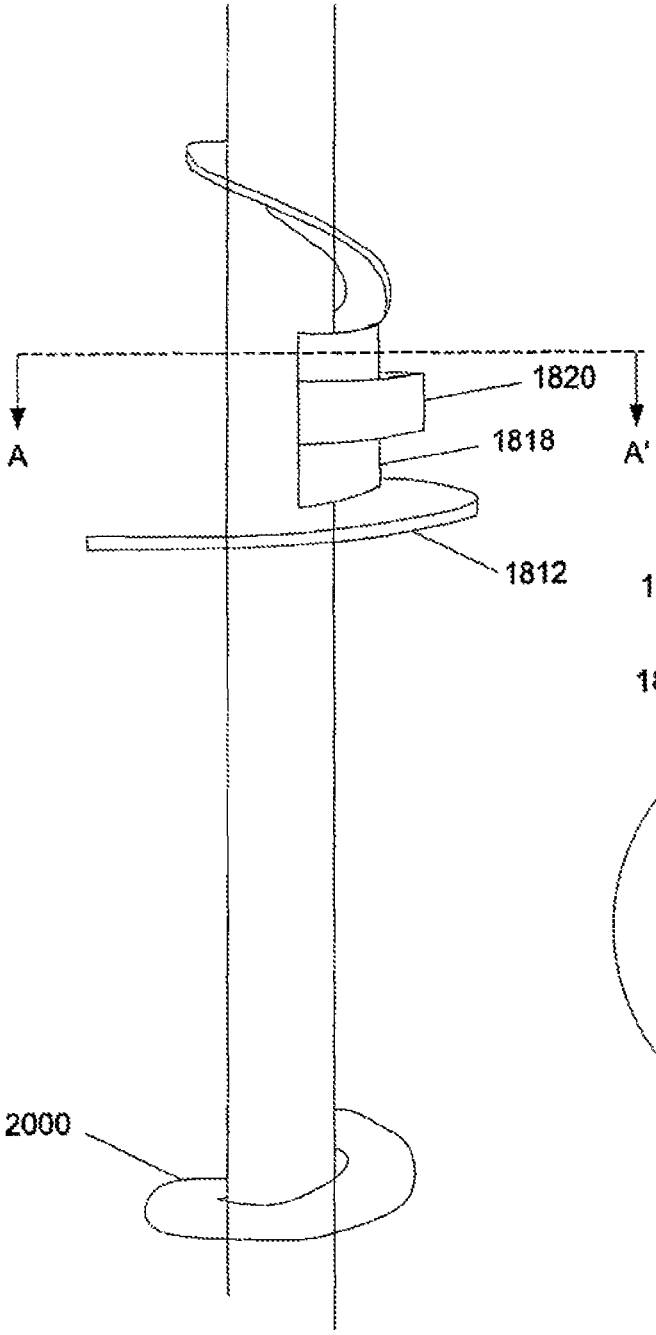
FIGS. 20A and 20B illustrate another auger shaft column from a side and top view along line A-A', respectively.
Figure 20B:
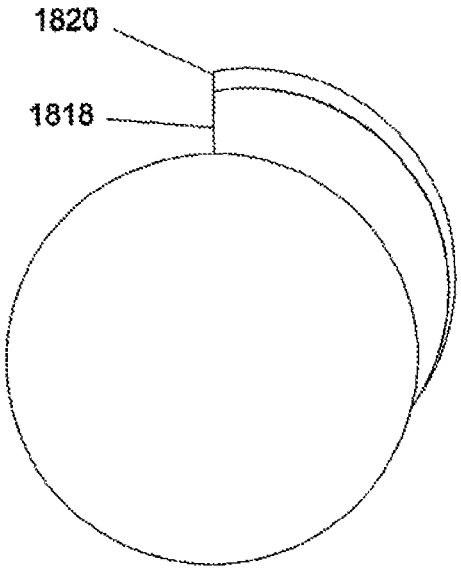

FIGS. 20A and 20B are similar to FIG. 19 except in that the lateral compaction projection 1818 and the deformation structure 1820 are elongated and wrap about a portion of the pile. In one aspect, a range between 45 and 360 degrees is covered by deformation structure 1820, including any subrange between.

FIG. 20A provides a profile view while FIG. 20B shows a top view along line A-A'. In the embodiment depicted in FIG. 20B, the compaction projection 1818 and deformation structure 1820 wraps about the pile to cover about 90 degrees. In another embodiment, at least about 45 degrees are covered. In another embodiment, at least about 180 degrees are covered.

In yet another embodiment, the entire surface (360 degrees) is covered. In yet another embodiment, more than 360 degrees is covered (e.g. multiple turns of a helix). The embodiment of FIGS. 20A and 20B show the width of compaction projection 1818 and deformation structure 1820 as diminishing over their length as the structure progresses around the circumference of the shaft. In another embodiment, the widths are consistent over their length. In yet another embodiment, the width increases as the structure progresses around the circumference of the shaft.

The embodiment of FIG. 20A includes a leading helix 2000 which is spaced apart from helical blade 1812 and lateral displacement projection 1818. Leading helix 2000 may be on the same shaft (e.g. monolithic or welded to the same shaft) as helical blade 1812 or may be on a separate shaft that is attached to the bottom section of the pile. In those situations where high density soil is disposed under a layer of loose, often corrosive soil, such a leading helix 2000 is particular advantageous.

The leading helix 2000 penetrates the dense soil while the helical blade 1812 and the lateral displacement projection 1818 remain in the looser soil. The grout that fills the bore diameter protects the column from the corrosive soil while the leading helix 2000 is securely imbedded in the denser soil.

Figure 21:
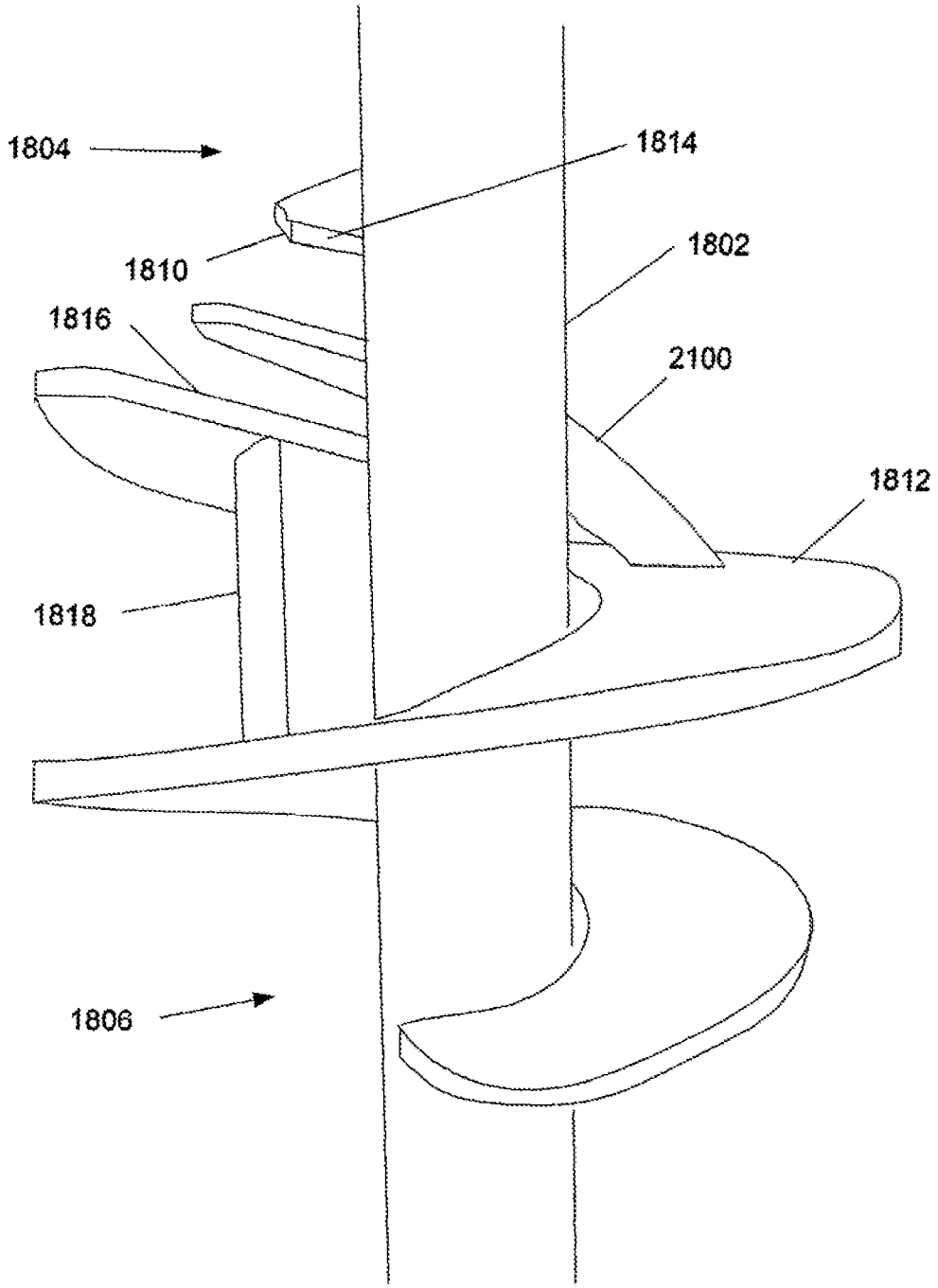
FIG. 21 illustrates the bottom section of another auger shaft.

FIG. 21 depicts the bottom section 1806 of another auger shaft which is similar to the shaft of FIG. 18 except in that deformation structure 2100 is attached to the topmost flighting of helical blade 1812. In the embodiment of FIG. 21, deformation structure 2100 is a helix having a same handedness as helical blade 1812 but a pitch that differs from the pitch of blade 1812. The deformation structure 2100 is positioned above compaction projection 1818 such that irregularities are formed in the circumference.

It will be appreciated that several of the above-disclosed embodiments and other features and functions, or alternatives thereof, may be desirably combined into many other different systems or applications. Also, various presently unforeseen or unanticipated alternatives, modifications, variations, or improvements therein may be subsequently made by those skilled in the art which are also intended to be encompassed by the description above.

What is claimed is:

1. A pile for being placed in a supporting medium comprising:

an elongated pile shaft;

a helical blade, operatively connected to said elongated pile shaft, having a leading edge and a trailing edge and configured to move the pile into the supporting medium;

a lateral compaction protrusion, formed on said elongated pile shaft, to create a bore within the supporting medium, the bore, created by said lateral compaction protrusion, having a diameter greater than a diameter of said elongated pile shaft;

a deformation structure to form a deformation in a wall of the bore created by said lateral compaction protrusion;

said lateral compaction protrusion extending, from said elongated pile shaft, a first distance, said first distance being equal to a radius of the bore created by said lateral compaction protrusion;

said deformation structure having a portion thereof being a second distance from said elongated pile shaft, said second distance being greater than said first distance.

2. The pile, as claimed in claim 1, wherein said deformation structure is located on said lateral compaction protrusion.

3. The pile, as claimed in claim 1, wherein said deformation is a helical deformation in the wall of the bore created by said lateral compaction protrusion.

4. The pile, as claimed in claim 1, wherein said deformation structure is located on said elongated pile shaft and said trailing edge of said helical blade.

5. The pile, as claimed in claim 2, wherein said deformation structure is located on said elongated pile shaft between said helical blade and said helical auger.

6. The pile, as claimed in claim 1, wherein said elongated pile shaft includes an opening to introduce material around said helical blade.

7. A pile for being placed in a supporting medium comprising:

an elongated pile shaft;

soil displacement head, operatively connected to said elongated pile shaft, configured to move the pile into the supporting medium and to create a bore in the supporting medium, the bore, created by said soil displacement head, having a diameter greater than a diameter of said elongated pile shaft;

a helical auger, operatively connected to said elongated pile shaft, configured to move material; and a deformation structure, located on said elongated pile shaft between said soil displacement head and said helical auger, to form a deformation in a wall of the bore created by said soil displacement head;

said soil displacement head extending, from said elongated pile shaft, a first distance, said first distance being equal to a radius of the bore created by said soil displacement head;

said deformation structure having a portion thereof being a second distance from said elongated pile shaft, said second distance being greater than said first distance.

8. The pile, as claimed in claim 7, wherein said deformation is a helical deformation in the wall of the bore.

9. A pile for being placed in a supporting medium comprising:

an elongated pile shaft;

a helical blade, operatively connected to said elongated pile shaft, having a leading edge and a trailing edge and configured to move the pile into the supporting medium;

an auger member, operatively connected to said elongated pile shaft, configured to move material; and a lateral compaction protrusion, formed on said elongated pile shaft, to create a bore within the supporting medium, the bore, created by said lateral compaction protrusion, having a diameter greater than a diameter of said elongated pile shaft;

said elongated pile shaft including an opening, located at a trailing edge portion of said helical blade, to introduce material around said helical blade.

10. The pile as claimed in claim 9, further comprising:

a deformation structure, located on said lateral compaction protrusion, to form a deformation in a wall of the bore created by said lateral compaction protrusion;

said lateral compaction protrusion extending, from said elongated pile shaft, a first distance, said first distance being equal to a radius of the bore created by said lateral compaction protrusion;

said deformation structure having a portion thereof being a second distance from said elongated pile shaft, said second distance being greater than said first distance.

11. The pile as claimed in claim 9, further comprising:

a deformation structure, located on said elongated pile shaft above said trailing edge of said helical blade, to form a deformation in a wall of the bore created by said lateral compaction protrusion;

said lateral compaction protrusion extending, from said elongated pile shaft, a first distance, said first distance being equal to a radius of the bore created by said lateral compaction protrusion;

said deformation structure having a portion thereof being a second distance from said elongated pile shaft, said second distance being greater than said first distance.

12. The pile, as claimed in claim 9, wherein said helical blade has a first handedness;

said helical auger having a second handedness;

said first handedness being different than said second handedness.

13. The pile, as claimed in claim 9, wherein said trailing edge of said helical blade including an opening to introduce material into the bore created by said lateral compaction protrusion.

14. The pile, as claimed in claim 9, wherein said trailing edge of said helical blade having a diameter greater than the diameter of said lateral compaction protrusion.

15. The pile, as claimed in claim 10, wherein said deformation is a helical deformation in the wall of the bore.

16. The pile, as claimed in claim 11, wherein said deformation is a helical deformation in the wall of the bore.

* * * * *